United States Patent [19]

Schaller

[11] Patent Number: 4,984,493

[45] Date of Patent: Jan. 15, 1991

[54] ADJUSTABLE COUNTER-TENSIONING MECHANISM FOR STRINGED INSTRUMENT TREMOLO DEVICE

[76] Inventor: Helmut F. K. Schaller, Kuckucksweg 16, 8501, Feucht, Fed. Rep. of Germany

[21] Appl. No.: 522,160

[22] Filed: May 11, 1990

[51] Int. Cl.[5] ..... G10D 3/00

[52] U.S. Cl. ..... 84/313

[58] Field of Search ..... 84/297 R, 307, 312 R, 84/313

[56] References Cited

U.S. PATENT DOCUMENTS

| | | | |
|---|---|---|---|
| 4,512,232 | 4/1985 | Schaller | 84/313 |
| 4,656,916 | 4/1987 | Gressett, Jr. | 84/313 |
| 4,941,384 | 7/1990 | Jäger | 84/313 |

*Primary Examiner*—Brian W. Brown

*Attorney, Agent, or Firm*—McCormick, Paulding & Huber

[57] ABSTRACT

A counter-tensioning mechanism for use with a tremolo device attached to a guitar or similar stringed musical instrument includes a moveable spring anchor for attachment to the ends of springs attached at their other ends to the string anchor of the device. Movement of the spring anchor in one direction or the other to increase or decrease the spring forces applied to the string anchor is effected by two parallel counter-rotating threaded shafts threadably engaging the spring anchor and driven in unison by two gears fixed to the shafts and drivingly connected with a manually rotatable third gear rotatable about a third axis preferably perpendicular to the plane of the first and second axes.

8 Claims, 3 Drawing Sheets

ADJUSTABLE COUNTER-TENSIONING MECHANISM FOR STRINGED INSTRUMENT TREMOLO DEVICE

FIELD OF THE INVENTION

This invention relates to stringed musical instruments, and deals more particularly with a mechanism for applying a counter-tensioning force to the string anchor of a tremolo device to counter-act the forces applied to the anchor by the instrument strings attached to it.

BACKGROUND OF THE INVENTION

In the case of guitars and similar stringed musical instruments it is well known to sometimes equip the instruments with tremolo devices operable by a player to periodically slightly vary the tension and/or length of the strings to cause the tones emitted by them to waver or fluctuate about the fundamental values selected by the stopping of the strings by the player's fingers.

By way of example, reference is made to U.S. Pat. No. 4,512,232 which shows a tremolo device. Typically in such devices the strings are anchored to a string anchor pivotal about a tremolo axis extending generally perpendicularly to the strings. The tension existing in the strings tends to rotate the string anchor in one direction about the tremolo axis, and one or more springs connected to the string anchor exert forces thereon tending to rotate it in the opposite direction about the tremolo axis in counteraction to the string tension. The springs and strings together bias the string anchor to a neutral position corresponding to the fundamental tuning of the strings. Attached to the string anchor is a tremolo arm engageable by the hand of a player and by means of which the player may rock the string anchor back and forth about the tremolo axis to create a tremolo effect wherein the tones produced by the strings are periodically varied slightly above and below the fundamental tuning.

The springs acting on the string anchor of a tremolo device are attached at their opposite ends to a spring anchor. It is known from U.S. Pat. No. 4,512,232, and from other prior tremolo devices, to make the spring anchor adjustable to allow the tension applied by the springs to the string anchor to be varied to suit the particular strings used with the stringed instrument. That is, different sets of strings may be used with the instrument and the total force applied by each set to the string anchor may vary from set to set. Therefore, if the spring anchor is properly set for one set of strings, at which setting the string anchor will be biased to a given neutral position about the tremolo axis at which the tremolo arm is at a desired disposition relative to the instrument top surface, the installation of another set of strings without changing the position of the spring anchor may cause the string anchor and the attached tremolo arm to depart from their desired neutral positions. This departure from the desired positions can be overcome by readjusting the position of the spring anchor to cause the tension imposed by the springs on the string anchor to better suit the forces imposed on the string anchor by the new set of strings.

Known mechanisms for adjusting the position of the spring anchor have, however, been difficult to operate and often require special tools and/or time consuming removal of cover plates or the like to gain axis to the mechanism.

The general object of the invention is therefore to provide an improved mechanism for setting and adjusting the counter-tension applied by springs to the string anchor of a tremolo device with such adjusting mechanism being simple to operate, using a commonly available tool and being capable of being adjusted without having to remove any cover plate or the like.

A further object of the invention is to provide a counter-tensioning mechanism of the aforegoing character which is relatively simple to manufacture, smoothly operating, and capable of being used with a wide variety of tremolo devices.

Other objects and advantages of the invention will be apparent from the following description of a preferred embodiment of the invention and from the appended claims taken in conjunction with the accompanying drawings.

SUMMARY OF THE INVENTION

The invention resides in a mechanism for applying a counter-tension to the spring anchor of a tremolo device used with a guitar or similar stringed musical instrument, with the mechanism including a base, first and second gears carried by the base for rotation about spaced first and second parallel axes, and a third gear rotatable about a third axis and drivingly connected with the first and second gears, the first and second gears having fixed thereto two threaded shafts for rotation therewith about said parallel axes, said two shafts threadably receiving a spring anchor which moves along the length of said shafts in response to rotation of said first and second gears by said third gear. The invention further resides in the axis of the third gear being perpendicular to the plane containing the axes of the two shafts.

In a more detailed aspect, the invention resides in the first and second gears being worm wheels and in the third gear being a worm located between and simultaneously engaging and driving the worm wheels, the worm having a socket or the like engageable with a tool for manually rotating it. The base can therefore be attached to an instrument with the threaded shafts extending generally parallel to the strings and with the third axis, about which the worm is rotatable, extending generally perpendicularly to the instrument top so that the worm can be rotated to adjust the position of the spring anchor by inserting a tool through a small opening in the instrument top or back into driving engagement with the worm.

DETAILED DESCRIPTION OF THE PREFERRED EMBODIMENT

Figure 4:
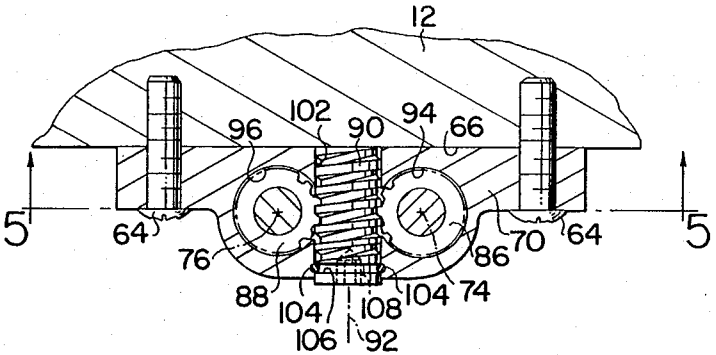
FIG. 4 is a sectional view through the counter-tensioning mechanism taken on the line 4—4 of FIG. 3.
Figure 5:
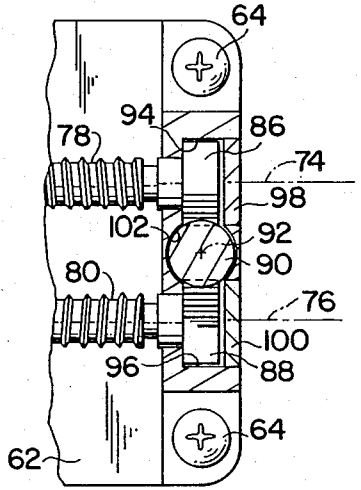
FIG. 5 is a sectional view through the counter-tensioning mechanism taken on the line 5—5 of FIG. 4.
Figure 1:
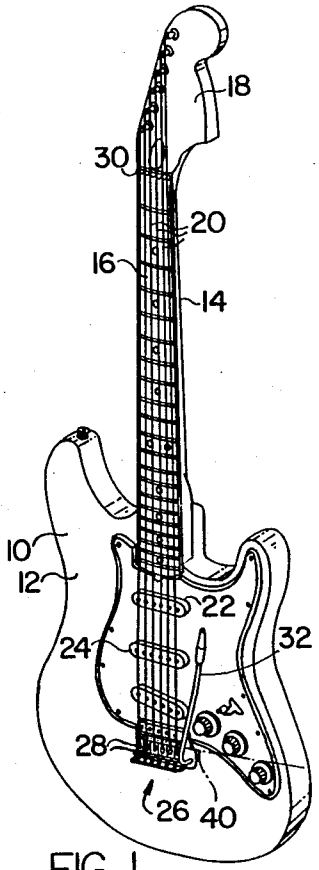
FIG. 1 is a perspective view of a guitar equipped with a tremolo device and an adjustable counter-tensioning mechanism embodying this invention.

Turning to the drawings, and first considering FIG. 1, a guitar 10 is illustrated as exemplary of a stringed musical instrument of the type with which the invention is concerned. The guitar 10 is of the solid body electrical type including a body 12, neck 14, fretboard 16, peghead 18, strings 20, electrical pickups 22 and 24 and a tremolo device 26. The tremolo device 26 serves, among other things, as a bridge and when the strings are unstopped they extend, as to their vibrating lenghts, from individual bridge pieces 28 on the tremolo device to the nut 30 at the upper end of the fretboard 16. The tremolo device includes an arm 32 which is operable by a player to periodically slightly vary the length and tension of the strings 20 to create a tremolo effect in the sounds generated by the strings.

Figure 2:
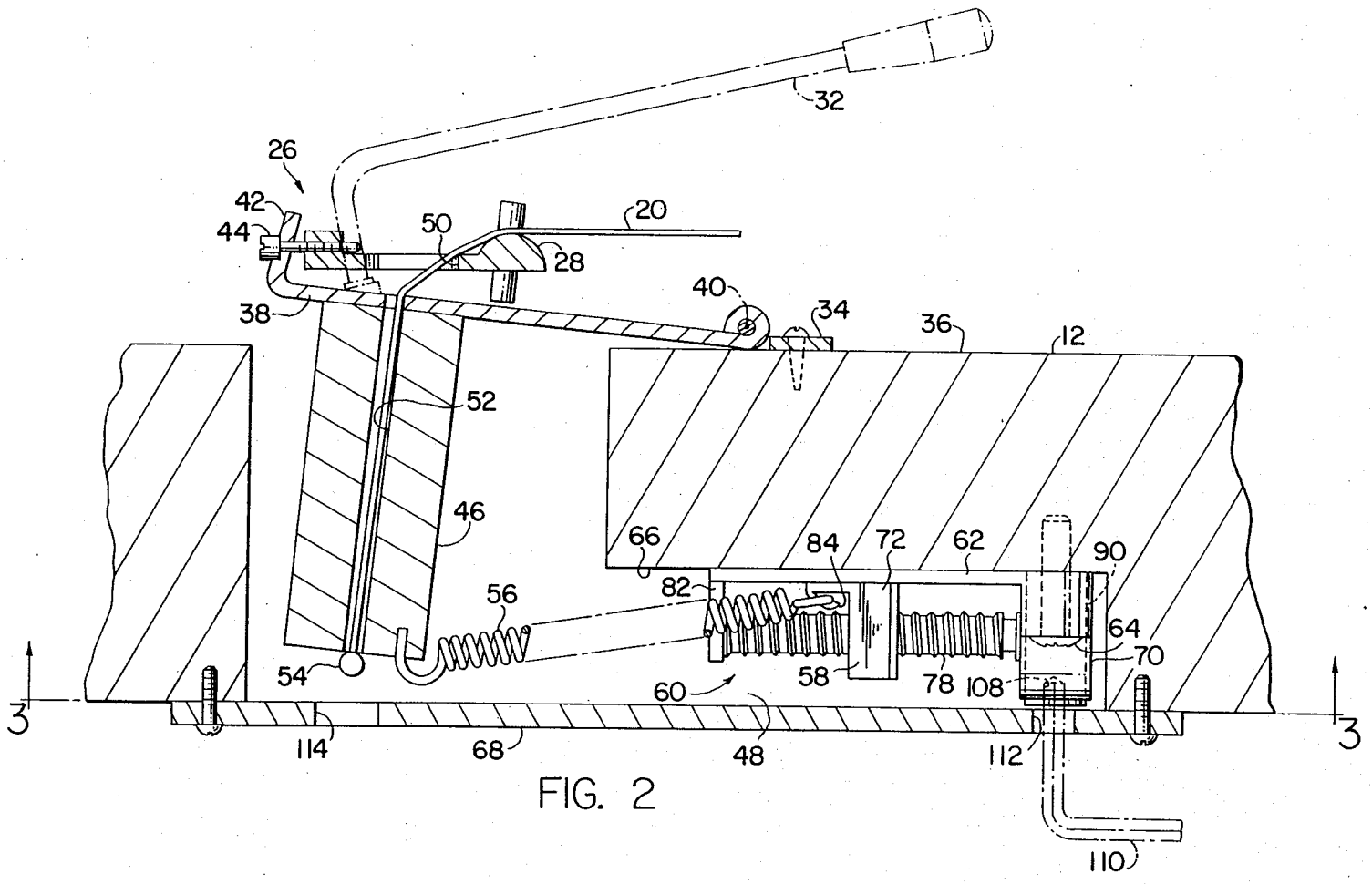
FIG. 2 is a fragmentary longitudinal sectional view taken on the line 2—2 of FIG. 1.
Figure 3:
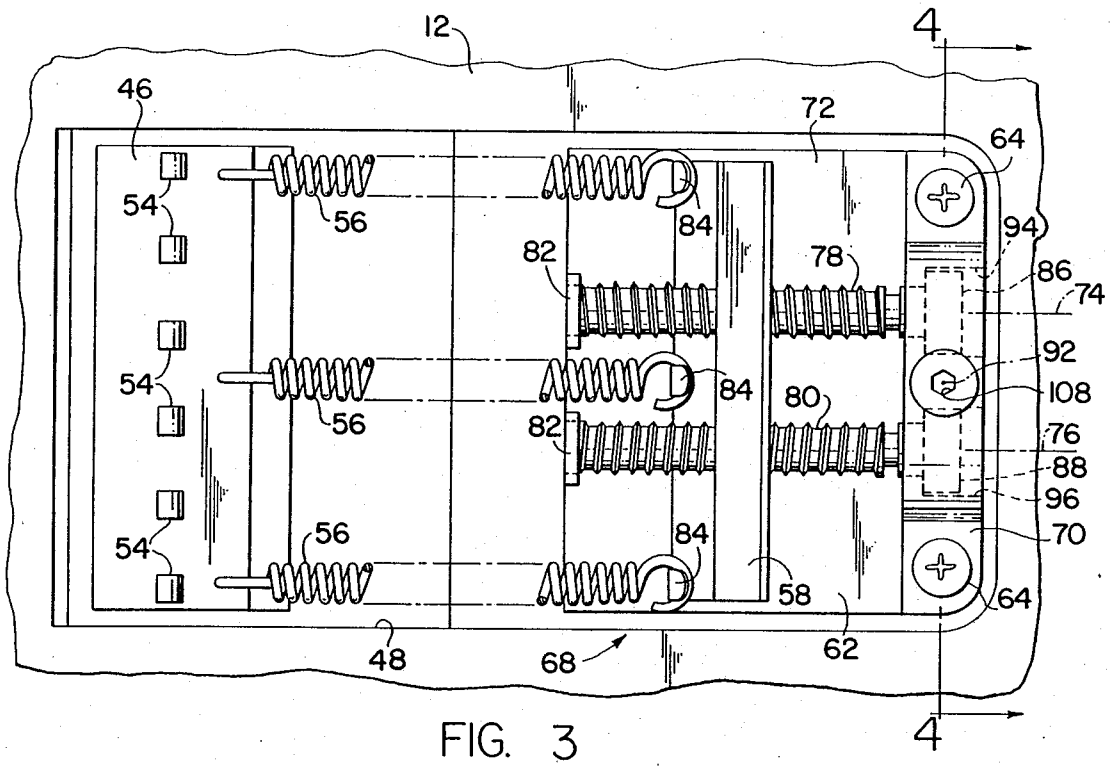
FIG. 3 is a rear view of the tremolo device and counter-tensioning mechanism taken generally on the line 3—3 of FIG. 2.

Various different tremolo devices may be used with the instrument 10 without departing from the invention, but in the illustrated case, as shown best in FIG. 2, the device includes a plate 34 attached to the top surface 36 of the instrument body 12 and having a string anchor 38 pivotally connected therewith for pivotal movement about a tremolo axis 40 extending generally perpendicularly to the strings 20. The string anchor 38 includes a plate 42 slideably supporting the bridge pieces 28 each of which is individually adjustable generally along the length of the instrument by an associated screw 44. Fixed to the plate 42 is a rearwardly extending portion 46 of the string anchor, the portion 46 being in the form of a block and extending into a recess 48 in the instrument body. As shown in FIG. 2, each string 20 passes through a hole 50 in its associated bridge piece 28 and through an associated hole 52 in the rearwardly extending block portion 46 of the string anchor. At its lower end, each string 20 carries a ball 54 or other suitable termination which bears against the lower end of the portion 46 to react the string tension.

From FIG. 2 it will be evident that the tension of the strings 20 tends to rotate the string anchor 26 clockwise about the tremolo axis 40. To counter-act this tendency, at least one spring, and in the illustrated case three springs, 56 are connected between the lower end of the string anchor block portion 46 and a spring anchor 58.

In keeping with the invention, the spring anchor 58 is part of an adjustable counter-tensioning mechanism, indicated generally at 60, by means of which the spring anchor 58 may be adjusted generally along the length of the body 12 to vary the force applied by the springs 56 to the string anchor.

Referring to FIGS. 2, 3, 4 and 5 the mechanism 60 includes a base 62 adapted to be fastened, as by screws 64, to a surface 66 of the recess 48 generally parallel to the top surface 36 of the body 12. As shown in FIG. 2 the surface 66 is a rearwardly facing one accessed from the rear of the instrument with the recess 48 being covered by a rear cover plate 68. However, in other instances the surface to which the base is fixed may be a forwardly facing one with the recess 48 being accessed from the top surface of the instrument as in U.S. Pat. No. 4,512,232.

The base 62 includes a housing portion 70 and a slide portion 72. The housing portion 70 carries first and second gears for rotation about first and second parallel axes 74 and 76 arranged generally parallel to the strings with the gears having fixed to them two threaded shafts 78 and 80 threadably engaged with the spring anchor 58. The ends of the shafts 78 and 80 remote from the housing 70 are rotatably supported by ears 82 on the corresponding end of the slide portion 72. The string anchor 58 is shaped so as to slide on the slide portion 72 of the base as it moves along the length of the shafts 78 and 80 and also includes three fingers 84 for attaching to it the associated three ends of the three springs 56.

The two gears fixed to the two threaded shafts 78 and 80 are drivingly connected with a single third gear which is manually rotatable. As a result, when the third gear is rotated by hand the two shafts 78 and 80 rotate in opposite directions. These shafts are threaded in opposite directions and the two holes in the spring anchor 58 which engage them are likewise threaded in opposite directions so that when the third gear is rotated by hand the spring anchor 58 moves in one direction or the other along the lengths of the shafts 78 and 80 depending on the direction of rotation of the third gear.

The first and second and third gears of the mechanism 60 may take various different forms and arrangements, but preferably and as illustrated the two gears fixed to the two shafts 78 and 80 are worm wheels 74 and 88 rotatable respectively about the axes 74 and 76 with the shafts 78 and 80 and the third gear is a worm 90 located between the two worm wheels, simultaneously drivingly engaging both worm wheels, and rotatable about a third axis 92 perpendicular to the plane of the axes 86 and 76. The two worm wheels 86 and 88 are received in complementary cylindrical recesses 94 and 96 in the housing portion 70 closed by caps 98 and 100. The worm 90 is received in a complementary cylindrical recess 102 in the base portion 70 and is held in place therein by two pins 104 received in holes in the housing portion and entering an annular groove 106 in the worm.

The outer end of the worm includes a means releasably engageable by a hand tool to allow it to be rotated about its axis 92. In the present instance, this means is shown to comprise a socket 108 of hexagonal cross-section suited, as illustrated by the broken lines of FIG. 2, to receive a portion of an Allen wrench 110. Since the axis 92 of the worm is arranged generally perpendicularly to the top surface 36 access to the worm may be had be passing the wrench 110 through a small opening 112 in the cover plate 68 thereby making it unnecessary to remove the cover plate when adjusting the mechanism 60. The cover plate 68 also preferably includes a number of holes 114 each aligned with a respective one of the string terminations 54 thereby permitting each string to be removed from and attached to the string anchor, by threading it through its hole 114, without removing the cover plate. Therefore, both the function of changing strings and of adjusting the mechanism 60 can be easily carried out with the cover plate remaining in place.

I claim:

1. An adjustable counter-tensioning mechanism for use with a stringed musical instrument having a body with a top surface, parallel strings extending over said top surface, a tremolo device having a string anchor pivotal about an axis generally perpendicular to said strings and parallel to the instrument top and also having a rear portion extending rearwardly into a recess in said instrument body, said strings being anchored to said string anchor and tending to rotate it in one direction about said tremolo axis, and at least one spring connected to said rear portion of said string anchor tending to rotate said string anchor in the opposite direction about said tremolo axis, said counter-tensioning mechanism comprising:

a base adapted for fixed attachment to said body of said stringed instrument, first and second gears carried by said base for rotation relative thereto about spaced first and second parallel axes, a third gear carried by said base for rotation relative thereto about a third axis and drivingly connected with said first and second gears so that when said third gear is rotated about said third axis said first and second gears rotate in opposite directions about said first and second parallel axes, two threaded shafts each connected to a respective one of said first and second gears for rotation with said first and second gears about said parallel axes, and a spring anchor threadably received by said two threaded shafts so as to be moved in one direction or another relative to said base along said parallel axes in response to rotation of said third gear in one direction or another about said third axis, said spring anchor including means for fastening thereto one end of said at least one spring another end which is fastened to said rear portion of said string anchor.

2. An adjustable counter-tensioning device as defined in claim 1 further characterized by said base having a housing portion carrying said first and second and third gears and a slide portion extending in one direction from said housing portion along the length of said first and second threaded shafts, said spring anchor being slideable along the length of said slide portion of said base.

3. An adjustable counter-tensioning device as defined in claim 2 further characterized by said slide portion of said base having means for rotatably supporting the ends of said first and second shafts remotely from said housing portion of said base.

4. An adjustable counter-tensioning mechanism as defined in claim 1 further characterized by said third axis being perpendicular to the plane of said first and second axes.

5. An adjustable counter-tensioning device as defined in claim 1 further characterized by said first and second gears being worm wheels and said third gear being a worm located between and engaging both of said worm wheels with said third axis about which said worm is rotatable being perpendicular to a plane containing said first and second parallel axes about which said worm wheels are rotatable.

6. An adjustable counter-tensioning device as defined in claim 5 further characterized by said worm including means engageable with a tool for manually rotating said worm about said third axis.

7. An adjustable counter-tensioning device as defined in claim 6 further characterized by said means engageable with a tool being a socket recess in said worm for receiving a complementarily shaped portion of said tool.

8. An adjustable counter-tensioning device as defined in claim 6 further characterized by said base including means for mounting it onto a surface of said recess disposed generally parallel to said instrument top surface with said third axis about which said worm is rotatable being arranged generally perpendicularly to said top surface when said base is mounted on said recess surface by said mounting means.

* * * * *